US010391781B1

(12) United States Patent
Nishimura

(10) Patent No.: US 10,391,781 B1
(45) Date of Patent: Aug. 27, 2019

(54) PRINTHEAD THAT EVACUATES AIR FROM A SUPPLY MANIFOLD

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/913,787

(22) Filed: Mar. 6, 2018

(51) Int. Cl.
*B41J 2/19* (2006.01)
*B41J 2/14* (2006.01)
*B41J 2/175* (2006.01)

(52) U.S. Cl.
CPC ..... *B41J 2/19* (2013.01); *B41J 2/1433* (2013.01); *B41J 2/14233* (2013.01); *B41J 2/14274* (2013.01); *B41J 2/17523* (2013.01); *B41J 2202/07* (2013.01)

(58) Field of Classification Search
CPC ..... B41J 2/19; B41J 2/14233; B41J 2/14274; B41J 2/17523; B41J 2/1433; B41J 2202/07
See application file for complete search history.

(56) References Cited

U.S. PATENT DOCUMENTS

2004/0004649 A1* 1/2004 Bibl ..... B41J 2/14233 347/68
2006/0103699 A1* 5/2006 Hoisington ..... B41J 2/14 347/74
2017/0341410 A1* 11/2017 Otis ..... B41J 2/19

* cited by examiner

*Primary Examiner* — Geoffrey S Mruk
(74) *Attorney, Agent, or Firm* — Duft & Bornsen, PC

(57) ABSTRACT

Printheads for jetting a print fluid. In one embodiment, a printhead comprises a main body configured to attach to a stack of plates, where the stack of plates forms a row of jetting channels configured to jet droplets of a print fluid. The main body includes a supply manifold configured to provide a fluid path for the print fluid to the row of jetting channels, a cavity, and a semi-permeable membrane disposed between the cavity and the supply manifold.

12 Claims, 5 Drawing Sheets

PRINTHEAD THAT EVACUATES AIR FROM A SUPPLY MANIFOLD

FIELD OF THE INVENTION

The following disclosure relates to the field of image formation, and in particular, to printheads and the use of printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and an actuator, such as a piezoelectric actuator. A printhead also includes a drive circuit that controls when each individual jetting channel fires based on image data. To jet from a jetting channel, the drive circuit provides a jetting pulse to the actuator, which causes the actuator to deform a wall of the pressure chamber. The deformation of the pressure chamber creates pressure waves within the pressure chamber that eject a droplet of print fluid (e.g., ink) out of the nozzle.

Drop on Demand (DoD) printing is moving towards higher productivity and quality, which requires small droplet sizes ejected at high jetting frequencies. The print quality delivered by a printhead depends on ejection or jetting characteristics, such as droplet velocity, droplet mass (or volume/diameter), jetting direction, etc. Unfortunately, air bubbles may be induced into the print fluid, which can negatively affect the jetting characteristics.

SUMMARY

Embodiments described herein provide an enhanced printhead that is able to remove air/gas from a supply manifold in the printhead. A supply manifold in a printhead provides a fluid path for a print fluid between a fluid source and a row of jetting channels of the printhead. To remove air/gas from the print fluid, the printhead has a cavity proximate to the supply manifold, and a semi-permeable membrane disposed between the cavity and the supply manifold. As the print fluid flows through the supply manifold, air in the print fluid is able to escape through the semi-permeable membrane and into the cavity, while the print fluid is contained in the supply manifold by the semi-permeable membrane. A vacuum may be applied to the cavity to assist in drawing the air from the print fluid and through the semi-permeable membrane. Evacuation of the air from the print fluid advantageously allows for more consistent droplet formation by the jetting channels and higher print quality.

One embodiment comprises a printhead that includes a main body configured to attach to a stack of plates, where the stack of plates forms a row of jetting channels configured to jet droplets of a print fluid. The main body includes a supply manifold configured to provide a fluid path for the print fluid to the row of jetting channels, a cavity, and a semi-permeable membrane disposed between the cavity and the supply manifold.

Another embodiment comprises a printhead that includes a main body, and a stack of plates attached to the main body, and that form a row of jetting channels configured to jet droplets of a print fluid. The main body includes a supply manifold configured to provide a fluid path for the print fluid to the row of jetting channels, a cavity fluidly isolated from the supply manifold, and a semi-permeable membrane disposed between the cavity and the supply manifold that is permeable to air and impermeable to the print fluid.

Another embodiment comprises a printhead that includes a rigid main body that includes a supply manifold for a print fluid, and a stack of plates attached to an interface surface of the main body, and that form a row of jetting channels configured to jet droplets of the print fluid. The main body includes a first supply port and a second supply port on an inlet surface opposite the interface surface, where the first supply port and the second supply port are separated by a distance along a length of the main body. The main body includes the supply manifold comprising a manifold duct that extends along the interface surface of the main body, a first fluid passage fluidly coupled between the first supply port and a first end of the manifold duct, and a second fluid passage fluidly coupled between the second supply port and a second end of the manifold duct. The main body includes a cavity, and a semi-permeable membrane disposed between the manifold duct and the cavity along a length of the manifold duct.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
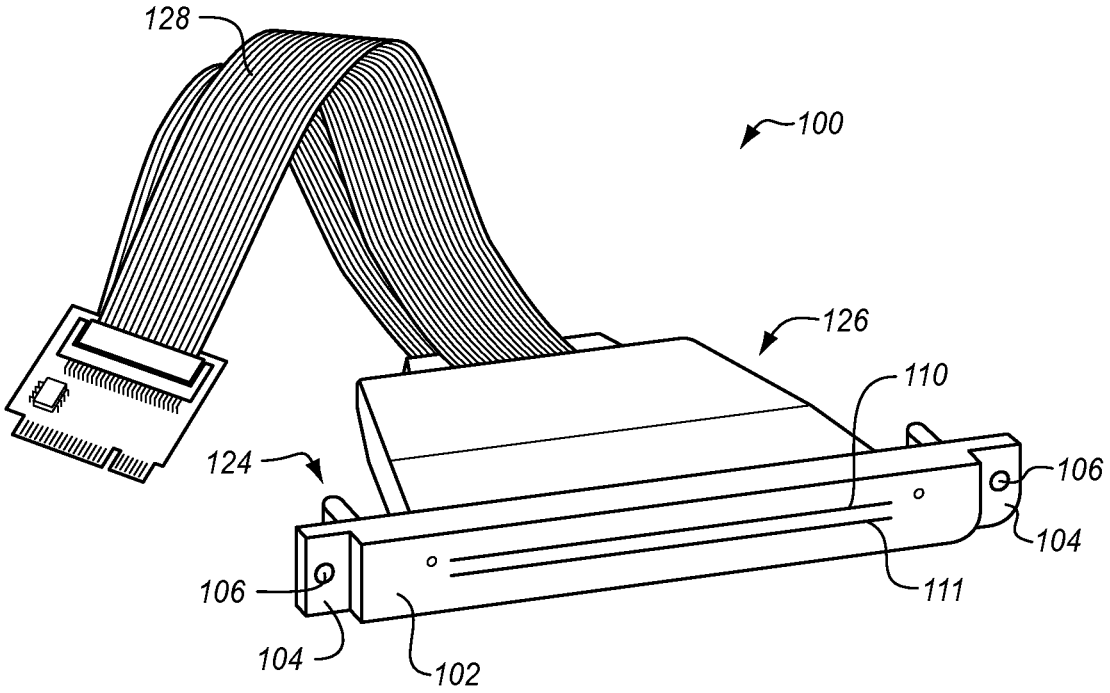
FIG. 1 is a perspective view of a printhead in an illustrative embodiment.

FIG. 1 is a perspective view of printhead 100 in an illustrative embodiment. Printhead 100 includes a nozzle plate 102, which represents the discharge surface of printhead 100. Nozzle plate 102 includes a plurality of nozzles that jet or eject droplets of print fluid onto a medium, such as paper, plastic, card stock, transparent sheets, a substrate for 3D printing, cloth, and the like. A print fluid is a liquid substance used for printing, such as ink, and may also be referred to as a print liquid. Nozzles of printheads 100 are arranged in one or more rows 110-111 so that ejection of print fluid from the nozzles causes formation of characters, symbols, images, layers of an object, etc., on the medium as printhead 100 and/or the medium are moved relative to one another. Although two rows 110-111 of nozzles are illustrated in FIG. 1, printhead 100 may include a single row of nozzles, three rows of nozzles, four rows of nozzles, etc. Printhead 100 also includes attachment members 104. Attachment members 104 are configured to secure printhead 100 to a jetting apparatus. Attachment members 104 may include one or more holes 106 so that printhead 100 may be mounted within a jetting apparatus by screws, bolts, pins, etc. Opposite nozzle plate 102 is the side of printhead 100 used for input/output (I/O) of print fluid, electronic signals, etc. This side of printhead 100 is referred to as the I/O side 124. I/O side 124 includes electronics 126 that connect to a controller board through cabling 128, such as a ribbon cable. Electronics 126 control how the nozzles of printhead 100 jet droplets in response to control signals provided by the controller board.

Figure 2A:
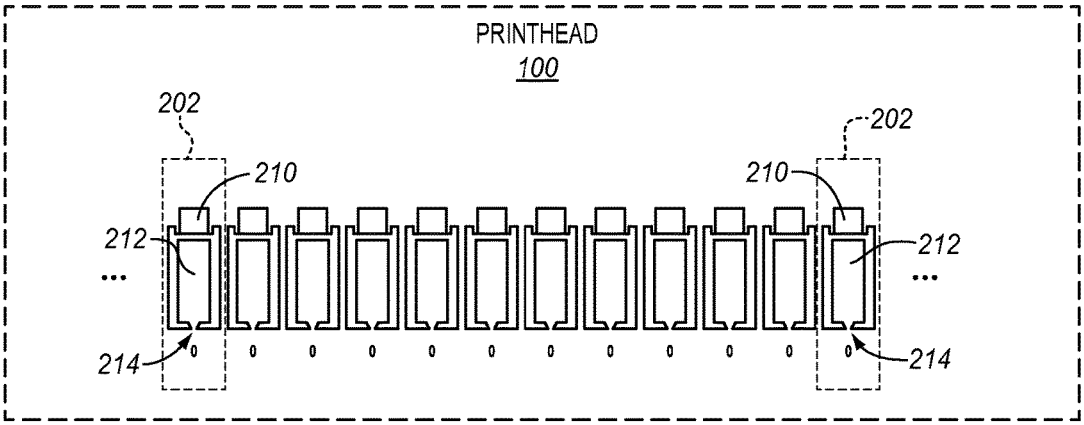
FIG. 2A is a schematic diagram of a row of jetting channels within a printhead in an illustrative embodiment.
Figure 2B:
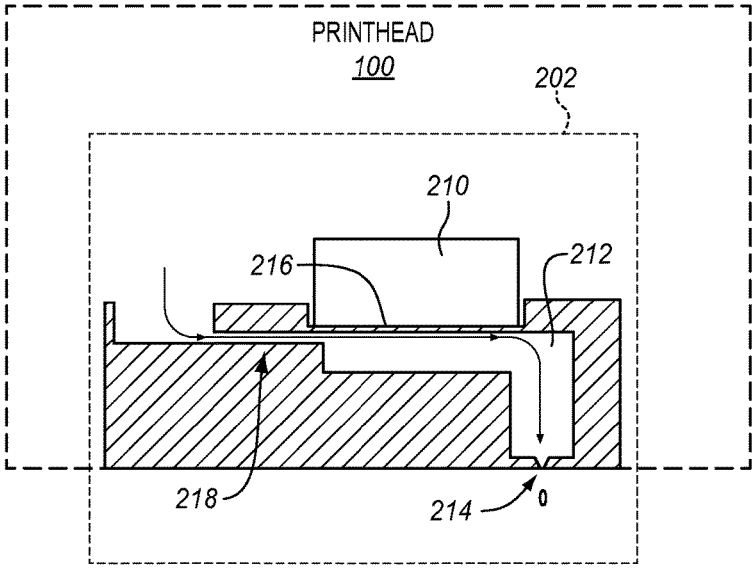
FIG. 2B is a schematic diagram of a jetting channel within a printhead in an illustrative embodiment.

FIG. 2A is a schematic diagram of a row 110 of jetting channels 202 within printhead 100 in an illustrative embodiment. Printhead 100 includes multiple jetting channels 202 that are arranged in a line or row (e.g., row 110 in FIG. 2) along a length of printhead 100, and each jetting channel 202 in a row may have a similar configuration as shown in FIG. 2A. Each jetting channel 202 includes a piezoelectric actuator 210, a pressure chamber 212, and a nozzle 214. FIG. 2B is a schematic diagram of a jetting channel 202 within printhead 100 in an illustrative embodiment. The view in FIG. 2B is of a cross-section of jetting channel 202 across a width of printhead 100. The arrow in FIG. 2B illustrates a flow path of a print fluid within jetting channel 202. The print fluid flows from a supply manifold in printhead 100 and into pressure chamber 212 through restrictor 218. Restrictor 218 fluidly connects pressure chamber 212 to a supply manifold, and controls the flow of the print fluid into pressure chamber 212. One wall of pressure chamber 212 is formed with a diaphragm 216 that physically interfaces with piezoelectric actuator 210. Diaphragm 216 may comprise a sheet of semi-flexible material that vibrates in response to actuation by piezoelectric actuator 210. The print fluid flows through pressure chamber 212 and out of nozzle 214 in the form of a droplet in response to actuation by piezoelectric actuator 210. Piezoelectric actuator 210 is configured to receive a drive waveform, and to actuate or "fire" in response to a jetting pulse on the drive waveform. Firing of piezoelectric actuator 210 in jetting channel 202 creates pressure waves in pressure chamber 212 that cause jetting of a droplet from nozzle 214.

Jetting channel 202 as shown in FIGS. 2A-2B is an example to illustrate a basic structure of a jetting channel, such as the actuator, pressure chamber, and nozzle. Other types of jetting channels are also considered herein. Some jetting channels may have a pressure chamber having a different shape than is illustrated in FIGS. 2A and 2B. Some jetting channels may use another type of actuator other than a piezoelectric actuator.

Figure 3:
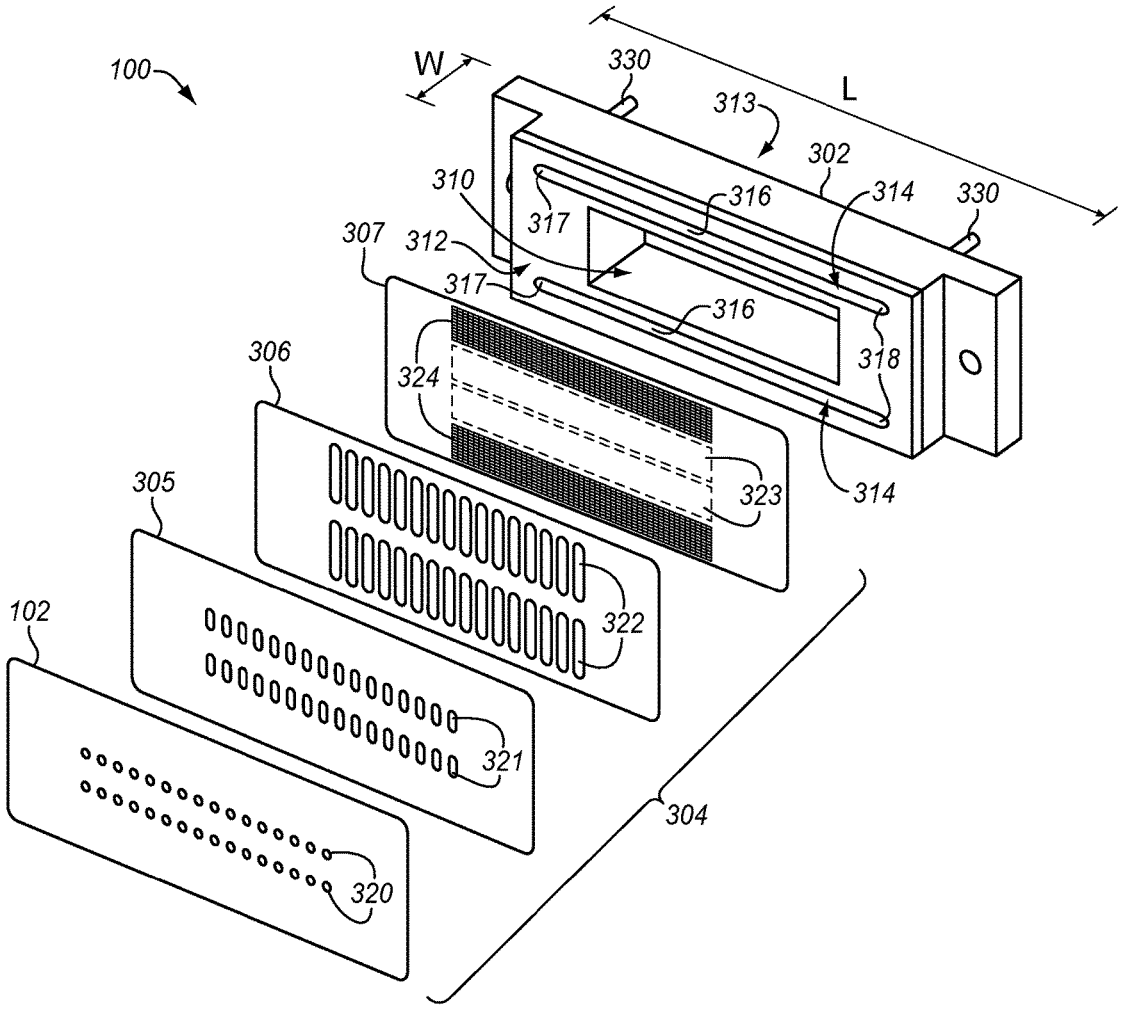
FIG. 3 illustrates an exploded, perspective view of a printhead in an illustrative embodiment.
Figure 4:
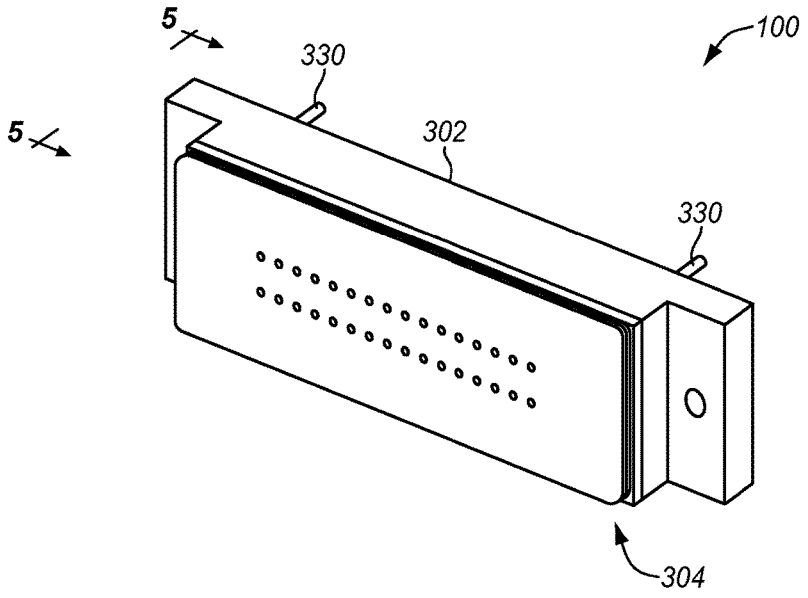
FIG. 4 is a perspective view of a printhead in an illustrative embodiment.

FIG. 3 illustrates an exploded, perspective view of printhead 100 in an illustrative embodiment. The illustration of printhead 100 in FIG. 3 is of a basic structure to show components of printhead 100, and the actual structure of printhead 100 may vary as desired. In this embodiment, printhead 100 is an assembly that includes a main body 302 and stack 304 of plates 102, 305-307 (also referred to as a laminate plate structure). Stack 304 is affixed or attached to main body 302, and forms one or more rows of jetting channels 202. FIG. 4 is a perspective view of printhead 100 in an illustrative embodiment. In FIG. 4, stack 304 is attached or affixed to main body 302.

In FIG. 3, main body 302 is an elongated member made from a rigid material, such as stainless steel. Main body 302 has a length (L) and a width (W), and the dimensions of main body 302 are such that the length is greater than the width. The direction of a row of jetting channels 202 corresponds with the length of main body 302. Main body 302 includes an access hole 310 at or near its center that extends from an interface surface 312 through to an opposing surface 313 (referred to as an inlet surface). Access hole 310 provides a passage way for an actuator assembly (not shown), such as a plurality of piezoelectric actuators, to pass through and interface with a diaphragm plate 307. Interface surface 312 is the surface of main body 302 that faces stack 304, and interfaces with a plate (e.g., plate 307) of stack 304. Main body 302 includes one or more supply manifolds 314 that extend substantially along a length of main body 302, and are configured to supply a print fluid to jetting channels 202 of printhead 100. A supply manifold 314 includes a manifold duct 316, which comprises an elongated cut or groove along interface surface 312 of main body 302 that is configured to convey a print fluid. Manifold duct 316 extends along interface surface 312 from a first end 317 to a second end 318, and aligns with a row of jetting channels 202. The length of manifold duct 316 may be at least as long as a row of jetting channels 202 in printhead 100.

Main body 302 also includes one or more supply ports 330 on inlet surface 313 that are configured to receive a print fluid from a fluid supply. For example, supply ports 330 may be connected to a fluid reservoir via hoses to receive print fluid from the fluid reservoir. Supply ports 330 are separated by a distance along a length of main body 302, such as on opposing sides of access hole 310. Supply manifold 314 is configured to provide a fluid path for the print fluid from supply ports 330 to the row of jetting channels 202, and the structure of supply manifold 314 is described in more below. Although not visible in FIG. 3, supply manifold 314 also includes fluid passages that extend between supply ports 330 and manifold duct 316. A fluid passage is a hole or opening that fluidly couples supply port 330 to manifold duct 316. Although multiple supply ports 330 are illustrated in this embodiment, a single supply port 330 may supply print fluid to supply manifold 314 in other embodiments.

In FIG. 3, plates 102 and 305-307 of printhead 100 are fixed, bonded, or otherwise attached to one another to form stack 304, and stack 304 is affixed to main body 302. Stack 304 includes the following plates in this embodiment: nozzle plate 102, a chamber plate 305, a restrictor plate 306, and a diaphragm plate 307. Nozzle plate 102 includes one or more rows of nozzle openings 320 that form the nozzles 214 of jetting channels 202. Chamber plate 305 includes one or more rows of chamber openings 321 that form pressure chambers 212 of jetting channels 202. Although one chamber plate 305 is illustrated, there may be multiple chamber plates 305 used to form pressure chambers 212. Restrictor plate 306 is formed with a plurality of restrictor openings 322 that form restrictors 218 of jetting channels 202. Restrictor openings 322 fluidly connect supply manifold 314 to chamber openings 321, and control the flow of print fluid into chamber openings 321. Diaphragm plate 307 is formed with diaphragm sections 323 and filter sections 324. Diaphragm sections 323 each comprise a sheet of semi-flexible material that forms diaphragms 216 for jetting channels 202. Filter sections 324 remove foreign matter from the print fluid entering into restrictor openings 322. As stated above, the assembly of printhead 100 may include more or different plates than are illustrated in FIG. 3.

Figure 5:
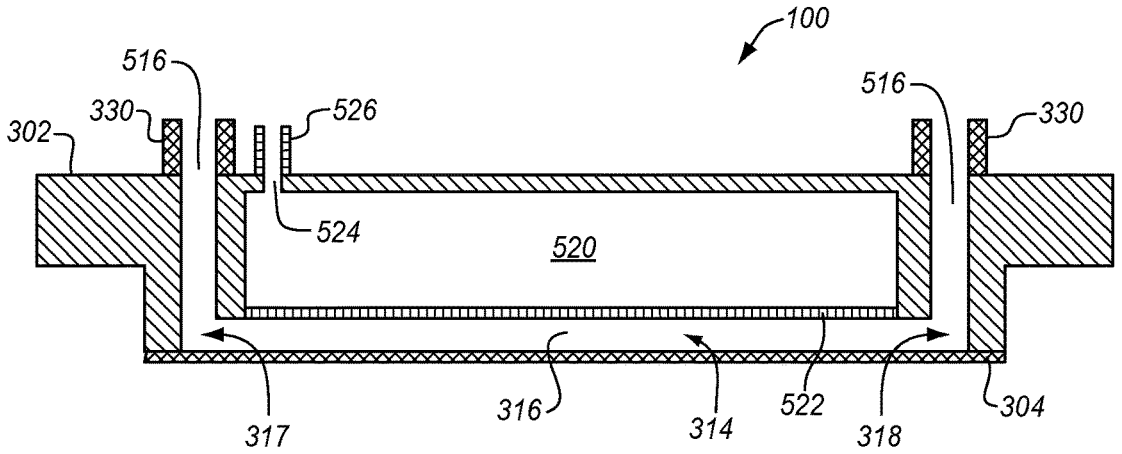
FIG. 5 is a cross-sectional view of a printhead in an illustrative embodiment.

FIG. 5 is a cross-sectional view of printhead 100 in an illustrative embodiment. The cross-section shown in FIG. 5 is along view arrows 5-5 in FIG. 4. Through this cross-sectional view, the elements of supply manifold 314 are visible. Supply manifold 314 is formed by manifold duct 316 of main body 302 that extends (left to right in FIG. 5) between ends 317-318. Supply manifold 314 is also formed by fluid passages 516 that fluidly couple supply ports 330 to opposing ends 317-318 of manifold duct 316. Thus, print fluid is supplied to manifold duct 316 at opposing ends 317-318 in this embodiment. Manifold duct 316 is a conduit for the print fluid to flow. The bottom portion of manifold duct 316 in FIG. 5 is open to the jetting channels 202 formed by stack 304. Thus, manifold duct 316 is the portion of supply manifold 314 that delivers the print fluid to the jetting channels 202.

Printhead 100 is enhanced in this embodiment with an air removal structure that assists in removing air from print fluid that flows within manifold duct 316. For the air removal structure, main body 302 includes a cavity 520, which comprises an empty space within main body 302 that is fluidly isolated from supply manifold 314. Cavity 520 is shown above manifold duct 316 in FIG. 5, but may be orientated on one or more sides of manifold duct 316. Main body 302 also includes a semi-permeable membrane 522 installed or disposed between supply manifold 314 and cavity 520. A semi-permeable membrane 522, which may also be referred to as an air-permeable or gas-permeable membrane, comprises a barrier, layer, plate, or sheet of material that is permeable to air or gas (i.e., allows air or gas to pass through it), and is impermeable to liquid or fluids (i.e., does not allow a fluid, such as a print fluid, to pass through it). For example, semi-permeable membrane 522 may comprise a thin plate or sheet of metallic material, such as Nickel, having very small holes, pores, or openings, such as in the range of 10-20 microns. Semi-permeable membrane 522 may be coated with a non-wetting coating. Semi-permeable membrane 522 may physically separate manifold duct 316 from cavity 520 along the entire length of manifold duct 316 so that no print fluid is allowed to pass into cavity 520. It is noted that references to a "fluid" herein refer to a liquid substance and not a gas.

In one embodiment, main body 302 may also include an air vent 524 coupled to cavity 520. Air vent 524 is configured to expel air that accumulates within cavity 520. Main body 302 may also include a vacuum port 526 coupled to air vent 524. Vacuum port 526 is configured to connect to a vacuum source (not shown) to draw or create a negative pressure or vacuum within cavity 520.

Figure 6:
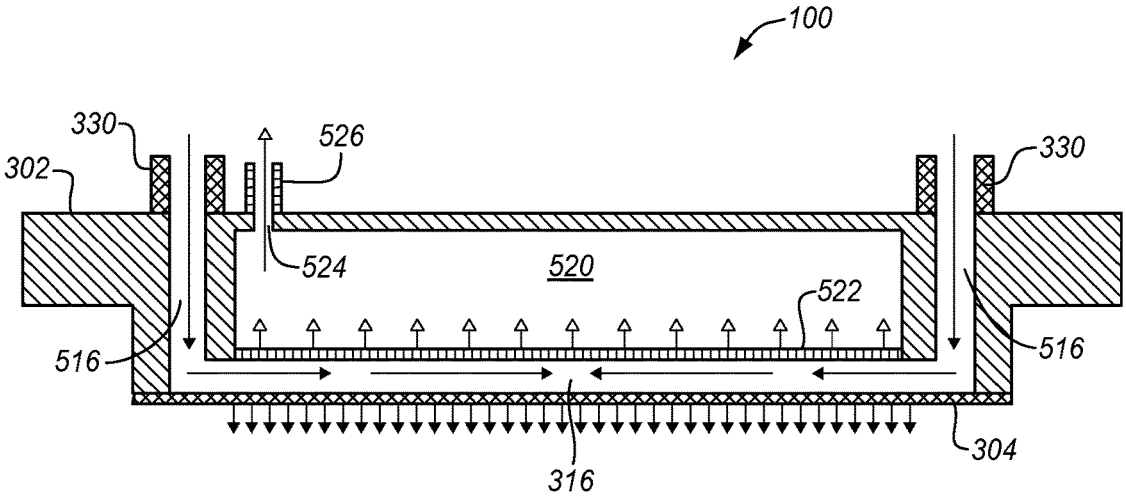
FIG. 6 is a cross-sectional view of a printhead showing a flow of print fluid in an illustrative embodiment.

FIG. 6 is a cross-sectional view of printhead 100 showing a flow of print fluid in an illustrative embodiment. The print fluid is received at supply ports 330, and flows through fluid passages 516 into manifold duct 316. The print fluid flows from the ends of manifold duct 316 toward a center of manifold duct 316. As the print fluid flows through manifold duct 316, air in the print fluid will escape through semi-permeable membrane 522 into cavity 520. At the same time, semi-permeable membrane 522 does not allow the print fluid to pass into cavity 520. The air that accumulates within cavity 520 may be expelled through air vent 524. If a vacuum source is attached to vacuum port 526, then a negative pressure or a vacuum is created within cavity 520. The vacuum in cavity 520 assists in drawing air out of the print fluid flowing in manifold duct 316, through semi-permeable membrane 522, into cavity 520 and out air vent 524. The amount of negative pressure may be high enough to draw air through semi-permeable membrane 522, but low enough to avoid drawing the print fluid through semi-permeable membrane 522.

The air removal structure in printhead 100 assists in removing air or gas bubbles that form in a print fluid. Air trapped in the print fluid can affect the jetting characteristics of the jetting channels 202 resulting in lower print quality. By removing air from the print fluid that flows in supply manifold 314, the print fluid supplied to the jetting channels 202 will be free or substantially free of air or gas bubbles. One technical benefit is that jetting of the print fluid by the jetting channels 202 will be more reliable and consistent, which results in higher print quality. Another benefit of the air removal structure is that it can act to dampen pressure waves generated by jetting operations. Semi-permeable membrane 522 may have some flexibility (e.g., when comprising a thin plate or membrane) and fluid menisci may form in the pores or openings in semi-permeable membrane 522. Both of these characteristics act to dampen pressure waves generated by jetting operations.

Although specific embodiments were described herein, the scope of the invention is not limited to those specific embodiments. The scope of the invention is defined by the following claims and any equivalents thereof.

What is claimed is:

1. A printhead comprising:

a main body comprising an elongated member made from a rigid material; and a stack of plates affixed to an interface surface of the main body, wherein the stack of plates forms a row of jetting channels configured to jet droplets of a print fluid;

wherein the main body includes:

an inlet surface that is opposite the interface surface;

a first supply port and a second supply port on the inlet surface configured to connect to a fluid reservoir via hoses to receive the print fluid from the fluid reservoir, wherein the first supply port and the second supply port are separated by a distance along a length of the main body;

a supply manifold configured to provide a fluid path for the print fluid to the row of jetting channels, wherein the supply manifold is formed by:

a manifold duct cut along a length of the interface surface of the main body from a first end to a second end, wherein a length of the manifold duct is at least as long as the row of jetting channels;

a first fluid passage that fluidly couples the first supply port to the first end of the manifold duct; and a second fluid passage that fluidly couples the second supply port to the second end of the manifold duct;

a cavity that runs the length of the manifold duct; and a semi-permeable membrane disposed between the cavity and the manifold duct along the length of the manifold duct.

2. The printhead of claim 1 wherein:

the main body further includes an air vent coupled to the cavity.

3. The printhead of claim 2 wherein:

the main body further includes a vacuum port attached to the air vent, and configured to couple to a vacuum source to create a vacuum in the cavity.

4. The printhead of claim 1 wherein:

the semi-permeable membrane comprises a plate of metallic material having a plurality of holes in the range of 10-20 microns.

5. A printhead comprising:

a main body comprising an elongated member made from a rigid material; and a stack of plates affixed to an interface surface of the main body, and that form a row of jetting channels configured to jet droplets of a print fluid;

wherein the main body includes:

an inlet surface that is opposite the interface surface;

a first supply port and a second supply port on the inlet surface configured to connect to a fluid reservoir via hoses to receive the print fluid from the fluid reservoir, wherein the first supply port and the second supply port are separated by a distance along a length of the main body;

a supply manifold configured to provide a fluid path for the print fluid to the row of jetting channels, wherein the supply manifold includes an elongated groove on the interface surface configured to receive the print fluid at opposing ends via the first supply port and the second supply port, and to convey the print fluid towards a center;

a cavity fluidly isolated from the supply manifold; and a semi-permeable membrane disposed between the cavity and the supply manifold that is permeable to air and impermeable to the print fluid, and is configured to allow air in the print fluid to escape into the cavity as the print fluid flows through supply manifold.

6. The printhead of claim 5 wherein:

the cavity is configured to accumulate air that escapes through the semi-permeable membrane from the print fluid flowing in the supply manifold; and the main body further includes an air vent coupled to the cavity that is configured to expel the air that accumulates in the cavity.

7. The printhead of claim 6 wherein:

the main body further includes a vacuum port attached to the air vent, and configured to couple to a vacuum source to create a vacuum in the cavity; and the vacuum in the cavity is configured to assist in drawing the air out of the print fluid flowing in the supply manifold and through the semi-permeable membrane.

8. The printhead of claim 5 wherein:

the semi-permeable membrane comprises a plate of metallic material having a plurality of holes in the range of 10-20 microns.

9. A printhead comprising:

a rigid main body that includes a supply manifold for a print fluid; and a stack of plates attached to an interface surface of the main body, and that form a row of jetting channels configured to jet droplets of the print fluid;

wherein the main body includes:

a first supply port and a second supply port on an inlet surface opposite the interface surface, wherein the first supply port and the second supply port are separated by a distance along a length of the main body;

the supply manifold comprising:

a manifold duct that extends along the interface surface of the main body;

a first fluid passage fluidly coupled between the first supply port and a first end of the manifold duct; and a second fluid passage fluidly coupled between the second supply port and a second end of the manifold duct;

a cavity; and a semi-permeable membrane disposed between the manifold duct and the cavity along a length of the manifold duct.

10. The printhead of claim 9 wherein:

the main body further includes an air vent coupled to the cavity.

11. The printhead of claim 10 wherein:

the main body further includes a vacuum port attached to the air vent, and configured to couple to a vacuum source to create a vacuum in the cavity.

12. The printhead of claim 9 wherein:

the length of the manifold duct is at least as long as the row of jetting channels.

* * * * *